US009101849B2

(12) United States Patent
Bedolla et al.

(10) Patent No.: US 9,101,849 B2
(45) Date of Patent: Aug. 11, 2015

(54) RECONFIGURABLE TOY VEHICLE

(75) Inventors: Mauricio Bedolla, Billund (DK); Glenn Yu, San Marino, CA (US); Kwun Chung Mo, El Segundo, CA (US); Michael Finizza, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 291 days.

(21) Appl. No.: 13/592,968

(22) Filed: Aug. 23, 2012

(65) Prior Publication Data

US 2013/0217298 A1 Aug. 22, 2013

Related U.S. Application Data

(60) Provisional application No. 61/528,633, filed on Aug. 29, 2011, provisional application No. 61/652,500, filed on May 29, 2012.

(51) Int. Cl.
*A63H 33/00* (2006.01)
*A63H 27/00* (2006.01)

(52) U.S. Cl.
CPC ..... *A63H 27/001* (2013.01); *A63H 33/003* (2013.01)

(58) Field of Classification Search
CPC ..... A63H 17/00; A63H 17/006; A63H 17/02; A63H 27/00; A63H 27/01; A63H 27/02; A63H 33/003
USPC ..... 446/230–232, 321, 34, 55
See application file for complete search history.

(56) References Cited

U.S. PATENT DOCUMENTS 2,272,643 A * 2/1942 Peters et al. ..... 446/230
2,503,707 A * 4/1950 Braman ..... 446/230
2,616,214 A * 11/1952 Hydrick ..... 446/55
2,896,369 A 7/1959 Palensky
4,244,144 A * 1/1981 Goldberg et al. ..... 446/279
4,249,339 A * 2/1981 Crain et al. ..... 446/231
4,467,556 A * 8/1984 Iwao et al. ..... 446/230
4,500,299 A * 2/1985 Kelley et al. ..... 446/230
4,668,205 A * 5/1987 Choy et al. ..... 446/230
4,717,365 A * 1/1988 Andersen et al. ..... 446/230
4,717,367 A * 1/1988 Stubenfoll et al. ..... 446/437
4,778,433 A * 10/1988 McKay et al. ..... 446/304
5,292,275 A * 3/1994 Swisher et al. ..... 446/409
5,626,506 A * 5/1997 Halford et al. ..... 446/465

(Continued)

OTHER PUBLICATIONS

Great Britain Search Report for British Application No. GB1215121.3 dated Oct. 19, 2012, 6 pages.

*Primary Examiner* — Gene Kim
*Assistant Examiner* — Alyssa Hylinski
(74) *Attorney, Agent, or Firm* — Edell, Shapiro & Finnan, LLC

(57) ABSTRACT

A toy vehicle is disclosed. The toy vehicle includes a body and portions or mechanisms that are movably coupled to the body. The movable portions are repositionable with respect to the body. The toy vehicle includes an actuator that can be moved relative to the body. Movement of the actuator causes at least one of the movable portions to be repositioned or moved relative to the body. The repositioning of the movable portions results in the toy vehicle having different configurations. The actuator can be placed in one of several positions relative to the body. The movement of the actuator from a first position to a second position causes a movable portion to move from a first position to a second position. The movement of the actuator from its second position to a third position causes another movable portion to move from its first position to its second position.

17 Claims, 13 Drawing Sheets

(56) References Cited

U.S. PATENT DOCUMENTS

| | | | | |
|---|---|---|---|---|
| 5,810,638 | A * | 9/1998 | Wood | 446/73 |
| 5,816,888 | A | 10/1998 | Myers | |
| 6,322,418 | B1 | 11/2001 | Hippely et al. | |
| 7,722,426 | B2 | 5/2010 | Campbell | |
| 7,950,979 | B2 * | 5/2011 | Barthold | 446/470 |
| 2001/0049249 | A1 | 12/2001 | Tachau et al. | |
| 2006/0270307 | A1 | 11/2006 | Montalvo et al. | |
| 2008/0070475 | A1 | 3/2008 | Hippely | |
| 2009/0075559 | A1 * | 3/2009 | Barthold | 446/470 |

* cited by examiner

RECONFIGURABLE TOY VEHICLE

CROSS-REFERENCE TO RELATED APPLICATION

This application claims priority to and the benefit of U.S. Provisional Patent Application No. 61/528,633, filed Aug. 29, 2011, entitled "Reconfigurable Toy Vehicle" and U.S. Provisional Patent Application No. 61/652,500, filed May 29, 2012, entitled "Reconfigurable Toy Vehicle" the entire disclosures of which are incorporated herein by reference in their entirety.

FIELD OF THE INVENTION

The present invention relates to a toy vehicle, and in particular, to a toy vehicle that has one or more portions that are repositionable or reconfigurable.

BACKGROUND OF THE INVENTION

Conventional toy vehicles are used by children in various play environments. Play involving a toy vehicle can be enhanced by providing the toy vehicle with the ability transform or be reconfigured.

There is a need for a toy vehicle that has one or more portions that are repositionable or reconfigurable to transform the toy vehicle. There is also a need for a toy vehicle that has a novel actuator or actuating mechanism.

SUMMARY OF THE INVENTION

The present invention is directed to a toy vehicle with a body and portions or mechanisms that are movably coupled to the body. In one embodiment, the movable portions are repositionable with respect to the body. The toy vehicle includes an actuator or actuating member or mechanism that can be moved relative to the body. Movement of the actuator causes at least one of the movable portions to be repositioned or moved relative to the body. The repositioning of the movable portions results in the toy vehicle having different configurations.

The actuator can be placed in one of several positions relative to the body. The movement of the actuator from a first position to a second position causes a movable portion to move from a first position to a second position. The movement of the actuator from its second position to a third position causes another movable portion to move from its first position to its second position.

In one embodiment, a toy vehicle comprises a body, a first mechanism coupled to the body at a first location, and a second mechanism coupled to the body at a second location, the second mechanism being different than the first mechanism, each of the first mechanism and the second mechanism being placeable in a first position relative to the body and in a second position relative to the body; and an actuator coupled to the first mechanism and the second mechanism, the actuator being movable relative to the body from a first position to a second position and to a third position, the movement of the actuator from the first position to the second position causing the first mechanism to move from its first position to its second position relative to the body, and the movement of the actuator from its second position to its third position causes the second mechanism to move from its first position to its second position relative to the body.

In an alternative embodiment, the actuator extends from the body a first distance in its first position and a second distance in its second position, and the second distance is greater than the first distance.

In an alternative embodiment, the actuator extends from the body a third distance in its third position, and the third distance is greater than the second distance and the first distance.

In an alternative embodiment, the body has a third mechanism coupled to the body at a third location, the third mechanism is placeable in a first position relative to the body and in a second position relative to the body, and the third mechanism moves from its first position to its second position as the actuator moves from its first position to its second position.

In an alternative embodiment, the first mechanism moves from its first position to its second position when the actuator reaches its second position.

In an alternative embodiment, the second mechanism moves from its first position to its second position when the actuator reaches its third position.

In an alternative embodiment, the toy vehicle is a toy plane, the first mechanism is a landing gear portion, the first position of the landing gear portion is an extended position and the second position of the landing gear portion is a retracted position.

In an alternative embodiment, the second mechanism is a cargo bay with cover portions, the first position of the cargo bay includes the cover portions being closed, and the second position of the cargo bay includes the cover portions being opened.

In an alternative embodiment, the third mechanism is a toy weapon, the first position of the toy weapon is a retracted position, and the second position of the toy weapon is an extended position.

In an alternative embodiment, the actuator is slidably mounted to the body, and the actuator is moved in a linear direction from its first position to its second position and to its third position.

In another embodiment, a toy vehicle comprises a body having a first mechanism coupled to the body at a first location, and a second mechanism coupled to the body at a second location, the second mechanism being different than the first mechanism, each of the first mechanism and the second mechanism being placeable in a first position relative to the body and in a second position relative to the body; and an actuator engageable with the first mechanism and the second mechanism, the actuator being movable relative to the body from a first position to a second position and to a third position, the actuator engaging the first mechanism when the actuator reaches its second position causing the first mechanism to move from its first position to its second position relative to the body, and the actuator engaging the second mechanism when the actuator reaches its third position causing to move from its first position to its second position relative to the body.

In another embodiment, a toy vehicle comprises a body having a first repositionable portion and a second repositionable portion; and an actuator movably coupled to the body, the actuator being disposable in a first actuating position and in a second actuating position relative to the body, the movement of the actuator from an initial position to the first actuating position causes the first repositionable portion to change its position relative to the body when the actuator reaches the first actuating position, and the movement of the actuator from the first actuating position to the second actuating position causes the second repositionable portion to change its position relative to the body when the actuator reaches the second actuating position.

BRIEF DESCRIPTION OF THE DRAWINGS

Like reference numerals have been used to identify like elements throughout this disclosure.

DETAILED DESCRIPTION OF THE INVENTION

Figure 1:
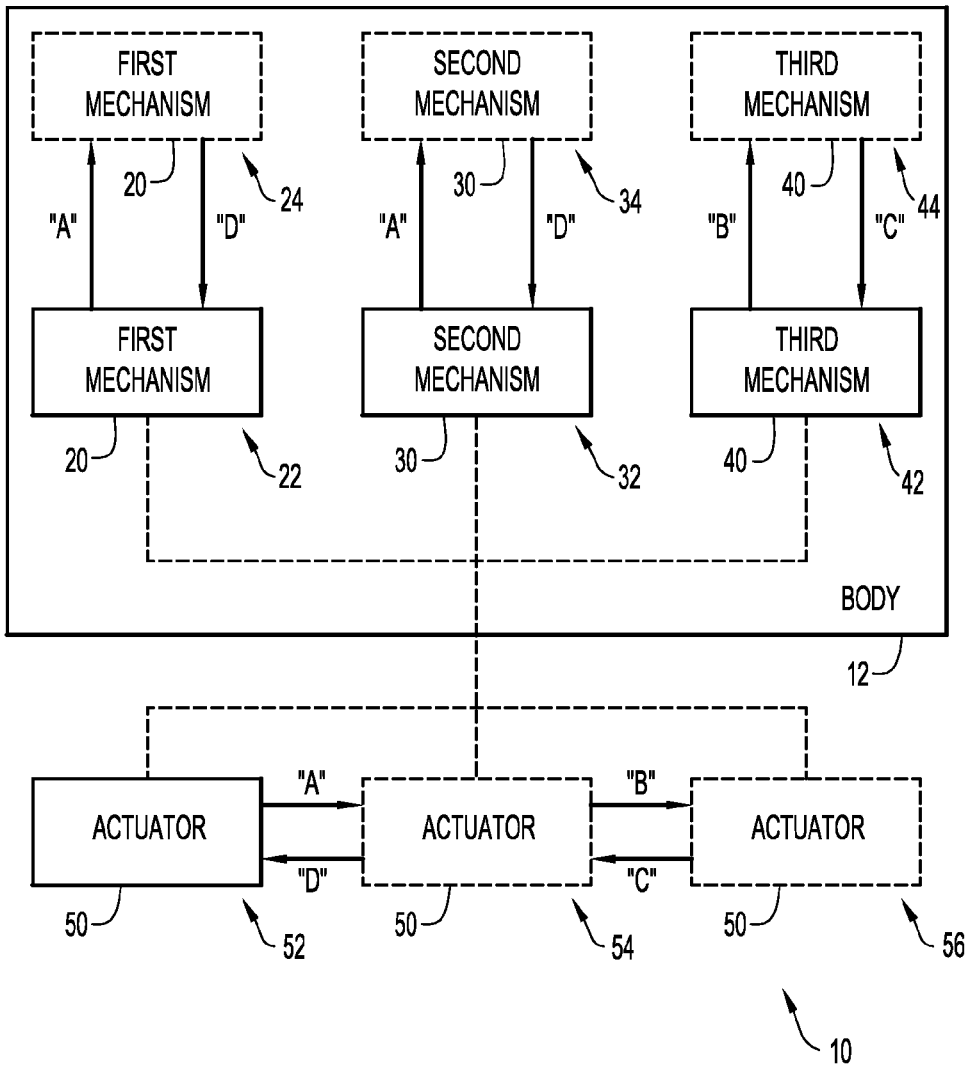
FIG. 1 illustrates a schematic block diagram of an embodiment of a toy vehicle according to the present invention.

Referring to FIG. 1, a schematic block diagram of a toy vehicle according to the present invention is illustrated. In this embodiment, the toy vehicle 10 includes a body 12 and an actuator 50 that is movable relative to the body 12. In various embodiments, the body 12 of the toy vehicle 10 is configured as a plane, a car, a train, a truck, or any other transportation device or mechanism. In other embodiments, the body 12 can resemble a structure other than a transportation device.

The toy vehicle 10 includes several portions or mechanisms that are movably coupled or mounted to the body 12. Being movably coupled to the body 12 allows the movable portions to be repositioned relative to the body 12. As a result, the body 12 can be reconfigured or transformed between different configurations. In one embodiment, each of the movable portions or mechanisms is pivotally coupled to the body 12. Alternatively, some of the movable portions are slidably coupled to the body 12.

Referring to FIG. 1, the repositioning of the movable portions or mechanisms of body 12 in response to movement of an actuator 50 is illustrated. The body 12 includes a first mechanism or movable portion 20, a second mechanism or movable portion 30, and a third mechanism or movable portion 40. The mechanisms 20, 30, and 40 can be referred to alternatively as repositionable portions. In one embodiment, each of the mechanisms 20, 30, and 40 is movable independent of the movement of the other mechanisms.

As described below, each of the mechanisms 20, 30, and 40 is placeable in at least a first position relative to the body 12 and a second position relative to the body 12, the second position being different from the first position. In one embodiment, the different positions of a mechanism correspond to extended and retracted positions relative to the body 12. An extended position of a mechanism is when the mechanism extends outwardly from the body 12. A retracted position of a mechanism is when a portion or all of the mechanism is moved into an opening or a recess formed in the body 12. Alternatively, the different positions of a mechanism correspond to closed and opened positions relative to the body 12.

The first mechanism 20 is movable between a first position or location 22 and a second position or location 24, either of which is an extended position and the other is a retracted position. Similarly, the second mechanism 30 is movable between a first position or location 32 and a second position or location 34, either of which is an extended position and the other is a retracted position. Also, the third mechanism 40 is movable between a first position or location 42 and a second position or location 44, either of which is an extended position and the other is a retracted position. Any of these extended and retracted positions can be opened and closed positions alternatively.

As mentioned above, the toy vehicle 10 includes an actuator 50 that is coupled to the body 12. The actuator 50 is movable relative to the body 12 and placeable in several different positions, which can be referred to as actuating positions. The positions of the actuator 50 are illustrated as positions 52, 54, and 56 in FIG. 1 and are representative of different locations of the actuator 50 relative to the body 12. The actuator 50 is engageable with the first mechanism 20, the second mechanism 30, and the third mechanism 30 such that a particular movement of the actuator 50 from one of its positions 52, 54, and 56 to another of its positions 52, 54, and 56 causes one or more of the first mechanism 20, the second mechanism 30, and the third mechanism 30 to move from one of its positions to the other of its positions.

The different arrows in FIG. 1 illustrate the associated movements of the actuator 50 and the mechanisms 20, 30, and 40. Movement of actuator 50 from its first position 52 to its second position 54 (shown by arrow "A") causes the first mechanism 20 to move from its first position 22 to its second position 24 (shown by arrow "A") and the second mechanism 30 to move from its first position 32 to its second position 34 (shown by arrow "A"). In one embodiment, the movements represented by the "A" arrows occur simultaneously. In another embodiment, the movements of mechanisms 20 and 30 occur when the actuator 50 reaches its second position 54 or just as the actuator reaches position 54. Thus, movement of the actuator 50 results in the reconfiguration of body 12 of the toy vehicle 10 based on the repositioning of the first mechanism 20 and the second mechanism 30.

While in this embodiment, the third mechanism 40 does not move in response to movement of actuator 50 from position 52 to position 54, in an alternative embodiment, such movement of the actuator 50 may also cause movement of the third mechanism 40.

Returning to FIG. 1, movement of the actuator 50 from its second position 54 to its third position 56 (shown by arrow "B") causes the third mechanism 40 to move from its first position 42 to its second position 44 (shown by arrow "B"). In one embodiment, the movements represented by the "B" arrows occur simultaneously. In another embodiment, the movement of the third mechanism 40 occurs when the actuator 50 reaches its third position 56 or just as the actuator 50 reaches its third position 56. Movement of the actuator 50 results in the additional reconfiguration of body 12 of the toy vehicle 10 based on the repositioning of the third mechanism 40.

While in this embodiment, the first mechanism 20 and the second mechanism 30 do not move in response to movement of actuator 50 from position 54 to position 56, in an alternative embodiment, such movement of the actuator 50 may also cause movement of the first mechanism 20 and/or movement of the second mechanism 30.

Movement of the actuator 50 from its third position 56 to its second position 54 (shown by arrow "C") causes the third mechanism 40 to move from its second position 44 to its first position 42 (shown by arrow "C"). In one embodiment, the movements represented by the "C" arrows occur simultaneously. In another embodiment, the movement of the third mechanism 40 occurs when the actuator 50 reaches its second position 54 or just as the actuator 50 reaches its second position 54. This movement of the actuator 50 transforms or reconfigures the body 12 of the toy vehicle 10 back to the configuration described above when actuator 50 is in position 54.

Likewise, movement of the actuator 50 from its second position 54 to its first position 52 (shown by arrow "D") causes the first mechanism 20 to move from its second position 24 to its first position 22 (shown by arrow "D") and the second mechanism 30 to move from its second position 34 to its first position 32 (shown by arrow "D"). In one embodiment, the movements represented by the "D" arrows occur simultaneously. In another embodiment, the movement of the first and second mechanisms 20 and 30 occur when the actuator 50 reaches its first position 52 or just as the actuator 50 reaches its first position 52. This movement of the actuator 50 transforms or reconfigures the body 12 of the toy vehicle 10 back to the configuration described above when actuator is in position 52.

In one embodiment, the body 12 includes detents or another similar positioning mechanism or structure that provides feedback to the user for when the actuator 50 has reached one of the positions 52, 54, or 56. Alternatively, positions 52 and 56 of the actuator 50 can be the limits of travel of the actuator 50 (such as hard stops) and the intermediate position 54 has a detent or positioning mechanism associated therewith.

In an alternative embodiment, the toy vehicle 10 may include more than three movable or repositionable mechanisms. Alternatively, one or more of the movable mechanisms of the toy vehicle 10 may be placeable in more than two different positions. Alternatively, the actuator may have more than three actuating positions.

Referring to FIGS. 2-6, different views of an embodiment of a toy vehicle according to the present invention is illustrated. In this embodiment, the toy vehicle 100 is configured to resemble an airplane. In other embodiments, the toy vehicle 100 can resemble a different transportation device, such as a car, a truck, or other type of vehicle.

The toy vehicle 100 includes a body 102 with a front end 104 and a rear end 106. The body 102 includes a cabin portion 108 with wings 110 and 112 and a tail or tail portion 114. Coupled to the wings 110 and 112 are several simulated engines 116. The body 102 has an upper surface 118 (see FIG. 2) and an opposite, lower surface 120 (see FIG. 4).

Figure 2:
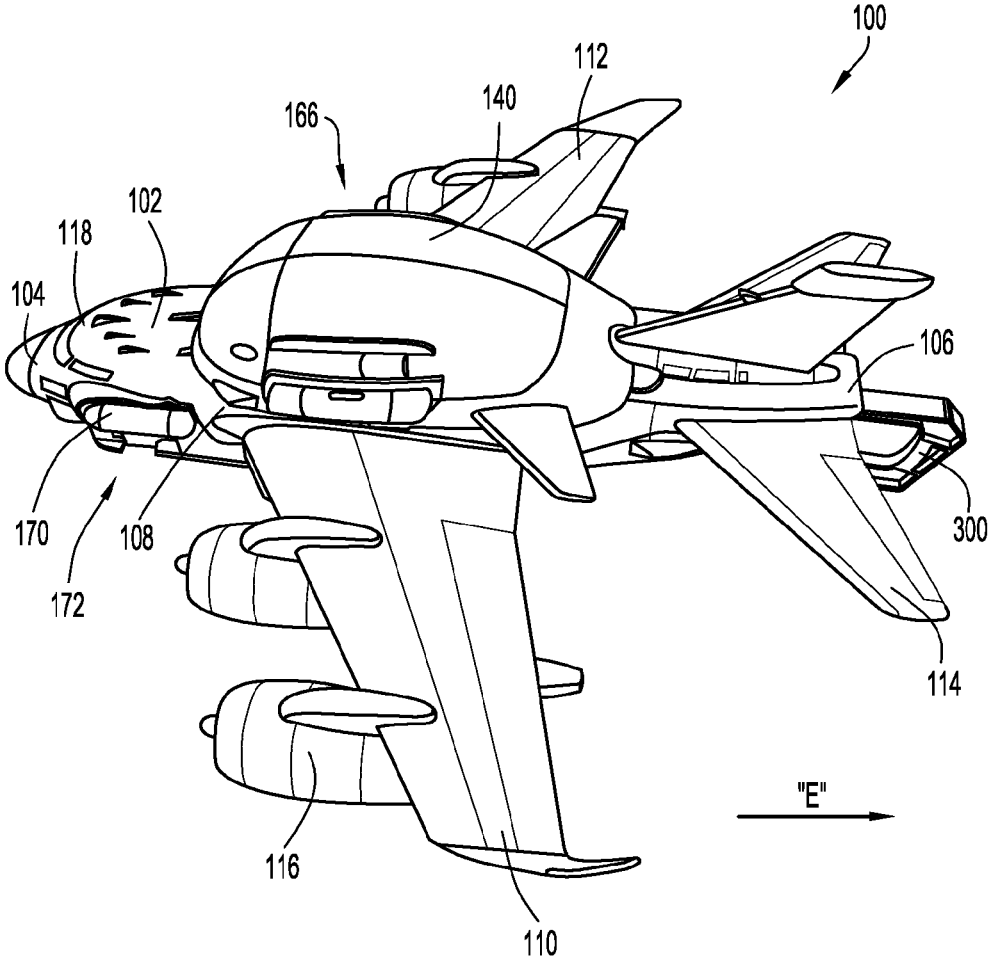
FIG. 2 illustrates a top perspective view of an embodiment of a toy vehicle in a first configuration according to the present invention.
Figure 3:
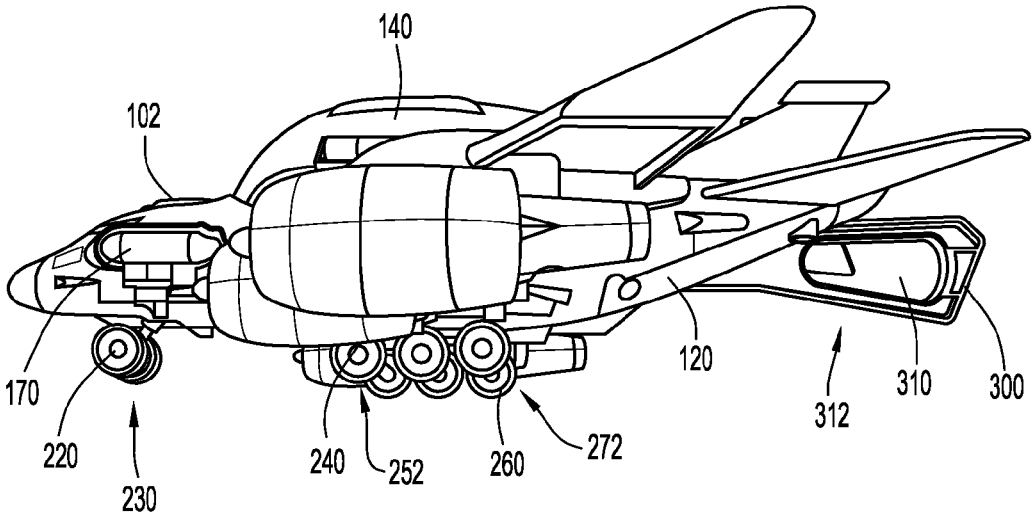
FIG. 3 illustrates a side view of the toy vehicle illustrated in FIG. 2.
Figure 4:
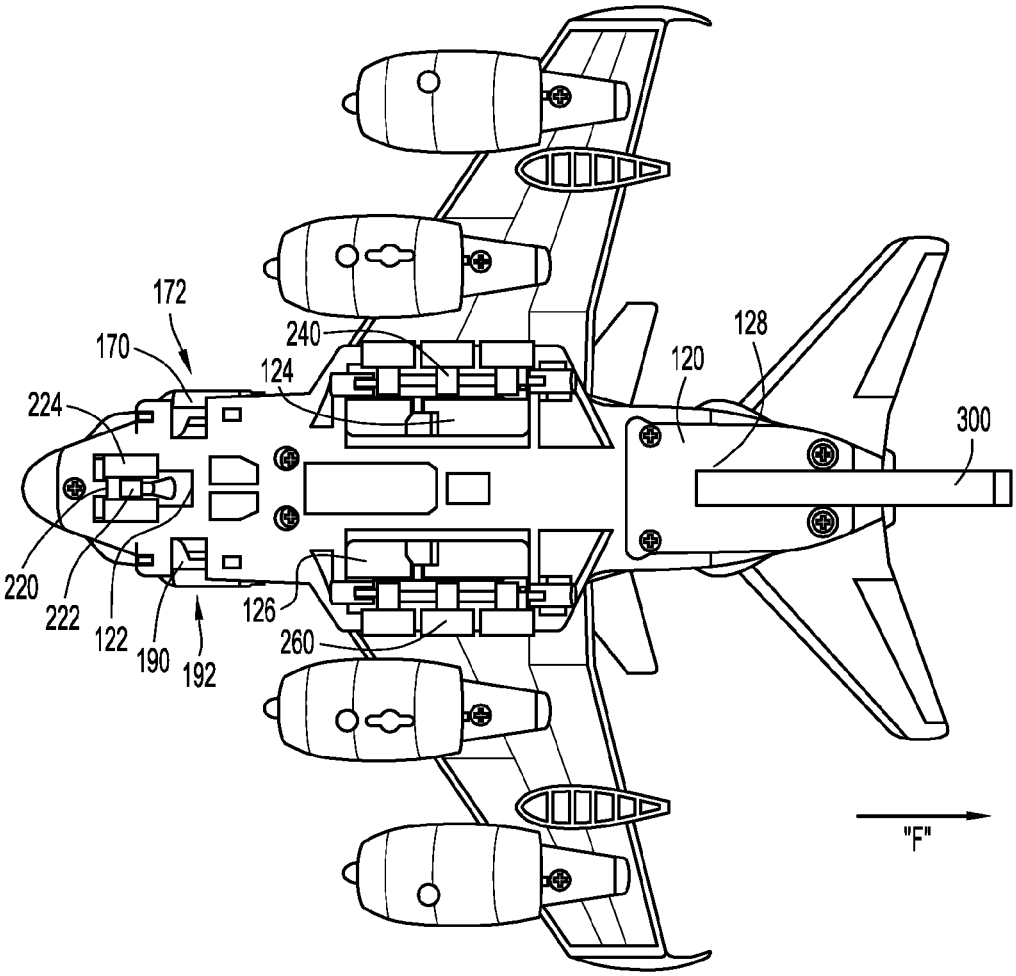
FIG. 4 illustrates a bottom view of the toy vehicle illustrated in FIG. 2.

The toy vehicle 100 includes several mechanisms or repositionable portions that are movable relative to the body 102 of the toy vehicle 100. One repositionable mechanism is a cargo bay 140 (see FIG. 2) that is coupled or mounted to the body 102 of the toy vehicle 100. Another repositionable mechanism is a pair of weapons 170 and 190 that is coupled or mounted to the toy vehicle body 102 as well (weapon 170 is illustrated in FIGS. 2 and 3 and weapons 170 and 190 are both illustrated in FIG. 4). Another repositionable mechanism is landing gear that is movably coupled to the toy vehicle body 102. Referring to FIGS. 3 and 4, different landing gear portions 220, 240, and 260 are coupled to the toy vehicle 102 at different locations and are movable relative thereto.

Referring back to FIG. 2, the cargo bay 140 is illustrated in a first position 166 in which the cargo bay 140 is closed. In addition, weapon 170 is illustrated in FIG. 2 in a retracted position 172 in which the weapon 170 does not extend outwardly from the body 102.

Referring to FIG. 3, in this configuration of the toy vehicle 100, in addition to the cargo bay 140 and the weapon 170 being in their closed and retracted positions, respectively, each of the landing gear portions is in its extended or deployed position relative to the body 102. In this position, each landing gear portion extends downwardly from the lower surface 120. Front landing gear 220 is illustrated in its extended position 230 and side landing gears 240 and 260 are illustrated in their extended positions 252 and 272, respectively.

Referring to FIG. 4, a bottom view of the toy vehicle 100 is illustrated. The weapons 170 and 190 are illustrated in their retracted positions 172 and 192, respectively. The openings or recesses for the landing gear portions are illustrated as well. Recesses 124 and 126 are formed in the lower surface 120 of the body and are configured to receive landing gear portions 240 and 260, respectively, when the landing gear portions 240 and 260 pivot from their illustrated extended or deployed positions to their retracted positions, as described below.

Figure 5:
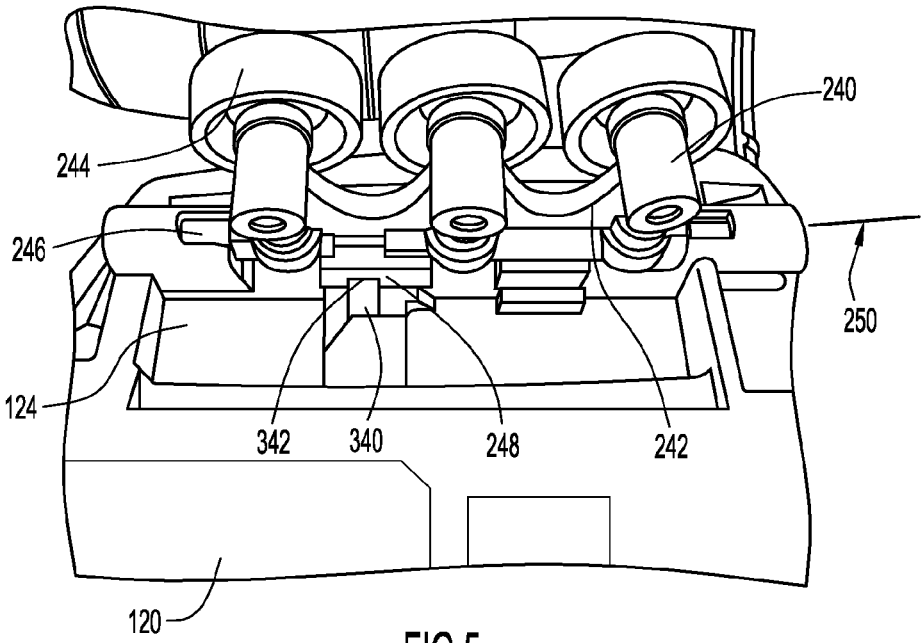
FIG. 5 illustrates a close-up bottom view of a portion of the toy vehicle illustrated in FIG. 2.

Referring to FIG. 5, a close-up view of a portion of the toy vehicle 100 including landing gear portion 240 is illustrated. The recess 124 in lower surface 120 is illustrated in detail. Landing gear portions 240 and 260 are constructed as minor-images of each other and accordingly, only landing gear portion 240 is described in detail. Landing gear portion 240 includes a body 242 with several wheels 244 rotatably coupled thereto. The body 242 is rotatably mounted on a pin or axle 246 that is coupled to the body 102. As a result, the body 242 can rotate about axis 250 between its deployed position illustrated in FIG. 5 and a retracted position. The body 242 includes an engagement member or tab 248 that is engaged by a cam surface 342 of a cam 340 that is coupled to an actuator, as described in detail below. The lower surface 122 has an opening through which the cam 340 can extend to engage the tab 248 and push the body 242 about axis 250 to its retracted position. When the cam 340 disengages from the tab 248, a biasing member, such as a spring, biases the landing gear portion 240 to its deployed position as illustrated.

Referring back to FIG. 4, the lower surface 120 also includes an opening 122 formed therein that is configured to receive the front landing gear portion 220 when portion 220 pivots from its extended or deployed position to its retracted position. The front landing gear portion 220 includes a base or body 222 that has a wheel 224 movably coupled thereto.

Figure 6:
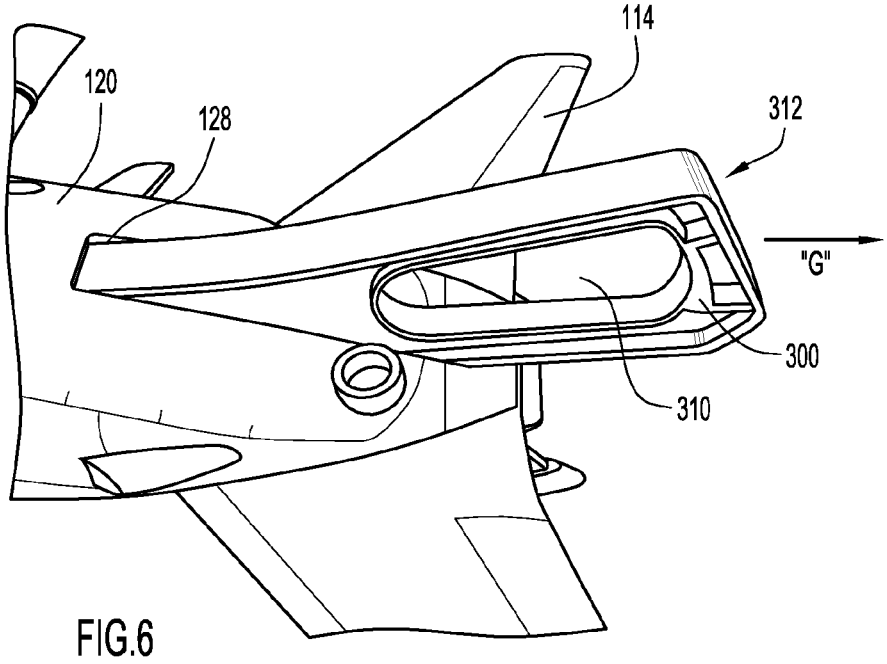
FIG. 6 illustrates a bottom perspective view of a portion of the toy vehicle illustrated in FIG. 2.

Also formed in the body 102 is an opening 128 from which an actuator 300 extends (see FIGS. 4 and 6). The actuator 300 is mounted for movement relative to the body 102 and is configured to be grasped by a user and moved. Referring back to FIG. 3, the actuator 300 includes an opening 310 formed therein that facilitates the grasping and pulling of the actuator 300 by the user.

The actuator 300 is illustrated in FIGS. 2-4 and 6 in its first position 312 relative to the toy vehicle body 102. The position 312 is illustrated in FIG. 6 with a portion of the opening 310 being located beneath the tail 114 of the toy vehicle 100. The actuator 300 can be pulled outwardly along the direction of arrow "E" in FIG. 2, arrow "F" in FIG. 4, and arrow "G" in FIG. 6 to move from its first position 312 to its second position 314 shown in FIG. 7.

Figure 7:
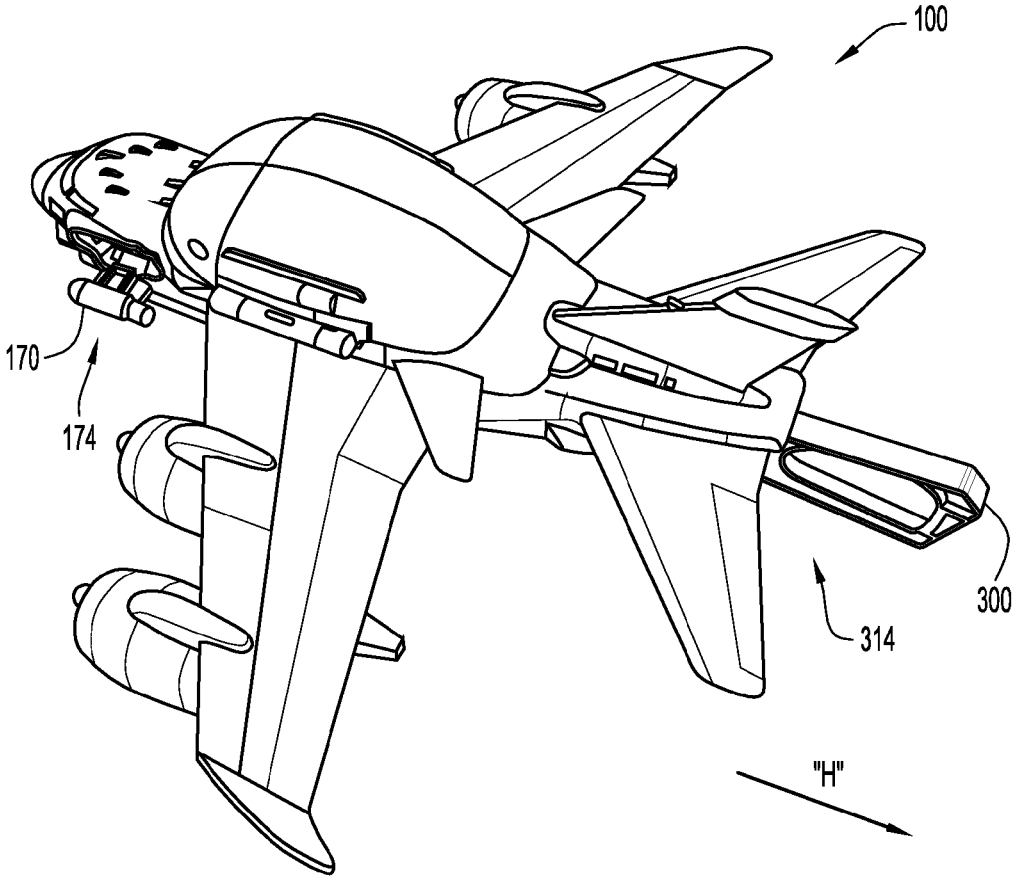
FIG. 7 illustrates a top perspective view of the toy vehicle illustrated in FIG. 2 in another configuration.

Referring to FIGS. 7-10, a second configuration of the toy vehicle 100 is illustrated. In this configuration, the actuator 300 has been moved along the direction of arrow "H" from its first position 312 to its second position 314, which is illustrated in FIG. 7. The actuator 310 extends slightly farther outwardly from the body 102 in position 314 than in position 312. This movement of the actuator 300 causes movement of the toy weapons 170 (see extended position 174 of weapon 170) and 190 from their retracted positions to their extended positions and movement of the landing gear portions 220, 240, and 260 from their extended or deployed positions to their retracted positions.

Figure 8:
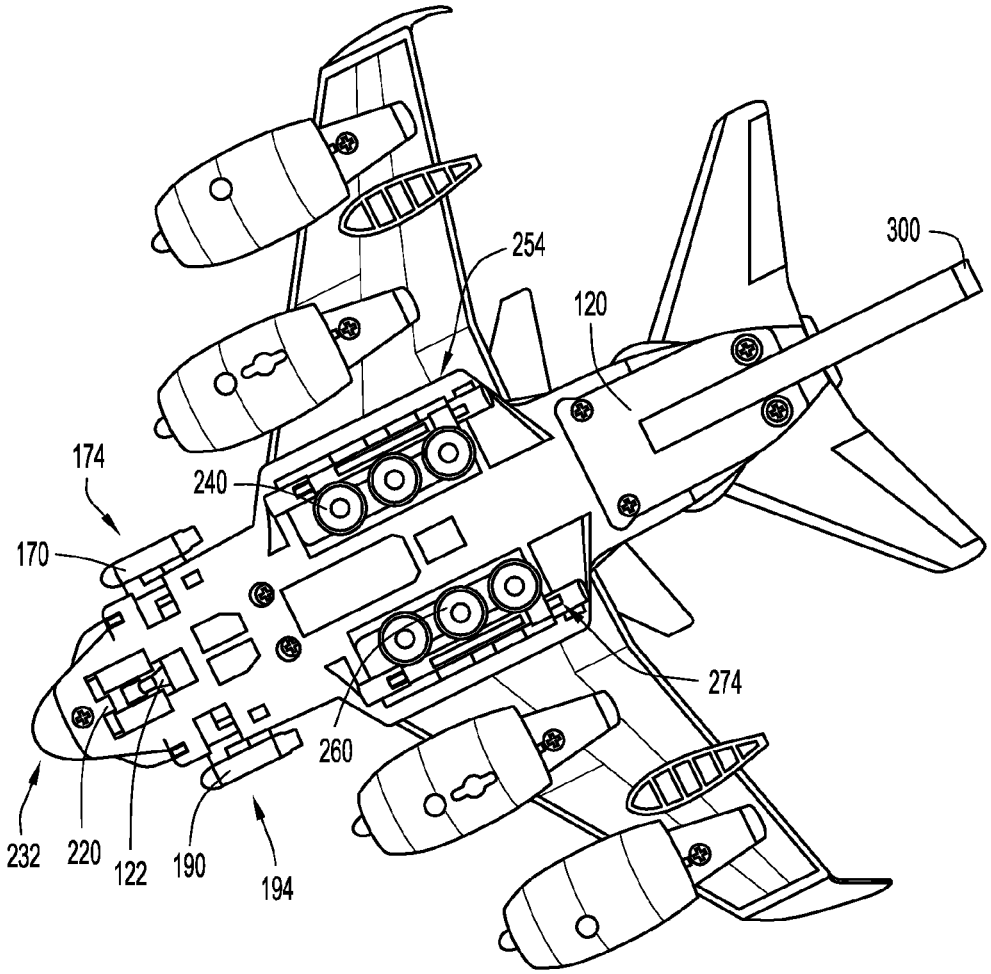
FIG. 8 illustrates a bottom view of the toy vehicle illustrated in FIG. 7.

Referring to FIG. 8, the repositioned weapons and landing gear portions are illustrated. Weapons 170 and 190 are illustrated in their extended or deployed positions 174 and 194, respectively. In these positions, the weapons 170 and 190 extend outwardly from opposite sides of the body 102. In addition, landing gear portions 220, 240, and 260 are moved to their respective retracted positions 232, 254, and 274. As described above relative to FIG. 5, landing gear portions 240 and 260 are moved or pivoted to their retracted positions 254 and 274, respectively, when cams moved by the actuator 300 engage and pivot the landing gear portions 240 and 260. Landing gear portion 220 is coupled to the actuator 300 so that rearward movement of the actuator 300 causes the landing gear portion 220 to pivot inwardly to its retracted position 232 in opening 122.

Figure 9:
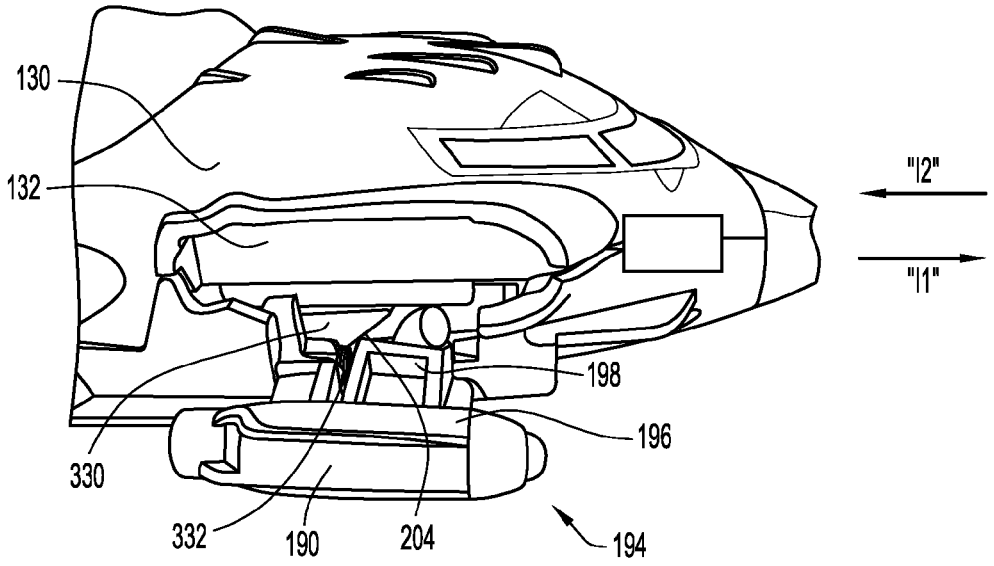
FIG. 9 illustrates a close-up side view of a portion of the toy vehicle illustrated in FIG. 7.
Figure 10:
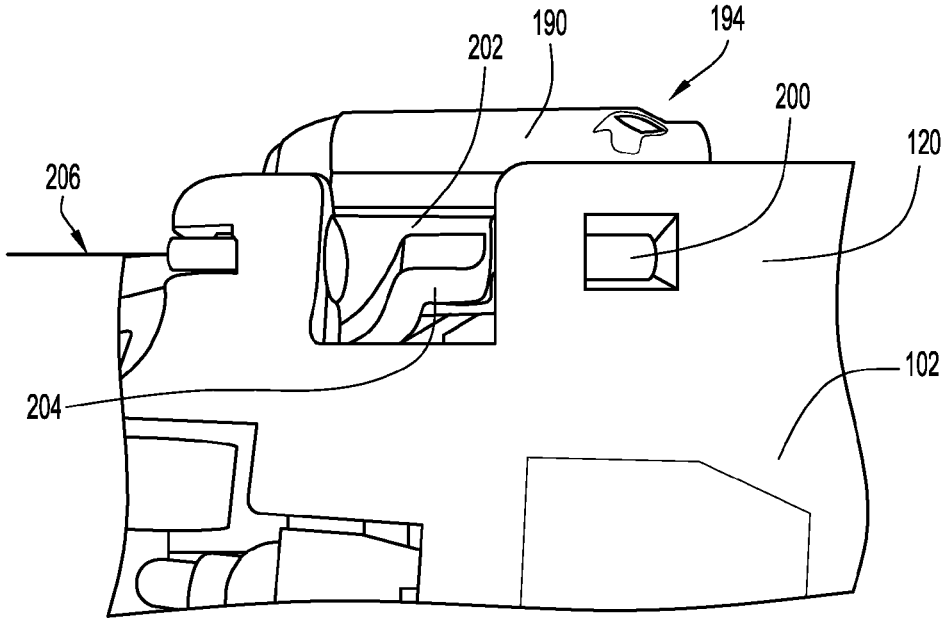
FIG. 10 illustrates a close-up bottom view of a portion of the toy vehicle illustrated in FIG. 7.

Referring to FIGS. 9 and 10, the movement of weapon 190 is illustrated. As weapons 170 and 190 are constructed as minor-images of each other and move in a similar manner, only weapon 190 is described in detail. Referring to FIG. 9, the recess 132 in side wall 130 of the toy vehicle 100 into which the weapon 190 is retracted is illustrated. The weapon 190 is illustrated in its extended position 194 in FIGS. 9 and 10.

The weapon 190 includes a body 196 with a mounting portion 198 with an opening or passage through which a pin or axle 200 is inserted. The pin 200 is mounted to the toy vehicle body 102 proximate lower surface 120. The weapon 190 is configured to rotate about pin 200, which defines an axis 206 of rotation for the weapon 190. A biasing member, such as a spring, is positioned to bias the weapon 190 about axis 206 from its retracted position 192 to its extended position 194.

The weapon 190 also includes an extension 202 with a cam or angled surface 204 formed thereon. Coupled to the actuator 300 is a cam 330 with a cam surface 332. The cam 330 is movable along the directions of arrows "I1" and "I2" in FIG. 9 in response to movement of the actuator 300. When the actuator 300 is in its first or fully retracted position 312, the actuator 300 has been moved along the direction of arrow "I1." Likewise, cam 330 has been moved along the same direction, resulting in the engagement of cam surface 332 with cam surface 204 of weapon 190. The engagement of the cam surfaces 332 and 204 causes the weapon 190 to rotate about axis 206 to its retracted position 192 and be held in that position as long as the surfaces 332 and 204 are engaged.

When the actuator 300 is moved along the direction of arrow "I2" from its first position 312 to its second position 314, the cam 330 moves along the direction of arrow "I2" as well. This movement results in the disengagement of cam surfaces 332 and 204 from each other, which allows the biasing member to pivot the weapon 190 from its retracted position 192 to its deployed or extended position 194. Weapon 170 is moved in a similar manner.

Figure 11:
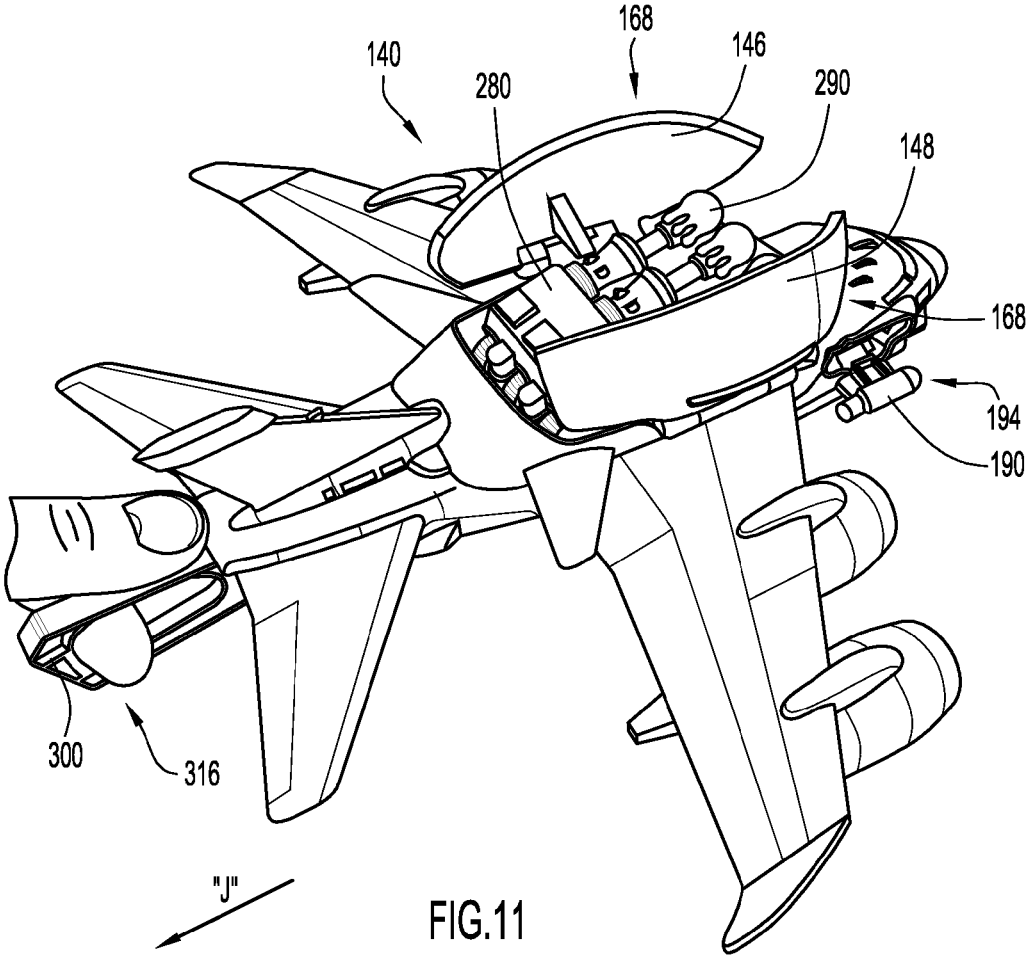
FIG. 11 illustrates a top perspective view of the toy vehicle illustrated in FIG. 2 in another configuration.
Figure 12:
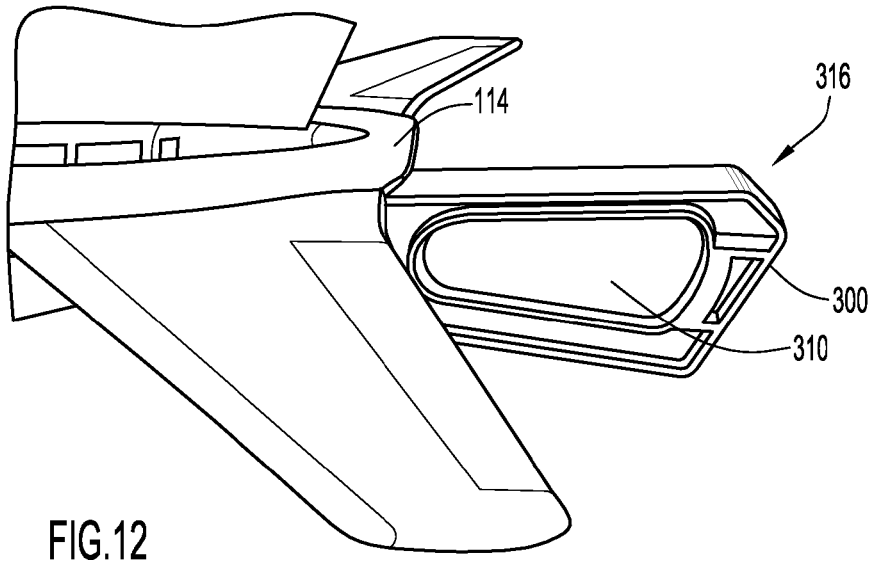
FIG. 12 illustrates a side view of a portion of the toy vehicle illustrated in FIG. 11.
Figure 13:
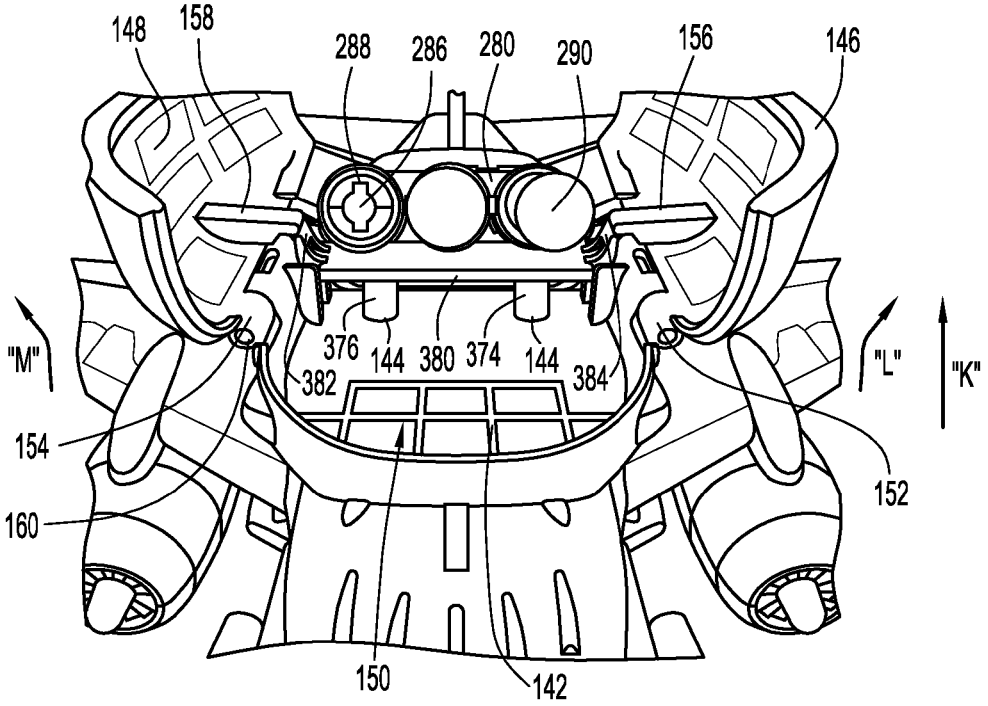
FIG. 13 illustrates a close-up front view of a portion of the toy vehicle illustrated in FIG. 11.

Referring to FIGS. 11-13, the toy vehicle 100 is illustrated in another configuration that is the result of movement of the actuator 300 along the direction of arrow "J" in FIG. 11. As shown in FIG. 12, the actuator 300 is moved to its third position 316 in which it extends outwardly farther than it does in positions 312 and 314. The third position 316 is noticeable in FIG. 12 as the opening 310 is located behind the tail 114.

As the actuator 300 moves from position 314 to position 316, the landing gear portions 220, 240, and 260 remain in their retracted positions and the weapons 170 and 190 remain in their extended positions (see weapon 190 in position 194 in FIG. 11). However, this movement of the actuator 300 results in the reconfiguration or repositioning of the cargo bay 140.

As shown in FIG. 11, the cargo bay 140 includes cover portions 146 and 148 that are pivotally coupled to the body 102. While the cover portions 146 and 148 are illustrated in their closed positions in FIGS. 2 and 7, the cover portions 146 and 148 are movable to opened positions 168 as the actuator 300 moves to its position 316. Located inside the cargo bay 140 is a weapon or projectile launcher 280 that moves as the cover portions 146 and 148 move. The weapon launcher 280 is configured to receive projectiles 290 and launch the projectiles 290 therefrom.

Referring to FIG. 13, the interior of the cargo bay 140 and its components are illustrated. The cargo bay 140 includes a base 142 to which the covers 146 and 148 are pivotally coupled by hinges 152 and 154, respectively. Hinges 152 and 154 are defined by pins (only pin 160 is referenced in FIG. 13 for simplicity). When the covers 146 and 148 are closed, the covers 146 and 148 and the base 142 collectively form an interior region or chamber 150. The base 142 has a pair of openings 144 formed therein.

A contact body 380 is movably mounted relative to the cargo bay 140. The contact body 380 is mounted on posts 374 and 376 that extend through the openings 144 in the base 142. As the actuator 300 moves from position 314 to position 316, the contact body 380 moves along the direction of arrow "K" in FIG. 13. The contact body 380 is positioned beneath the weapon launcher 280 and pivots the weapon launcher 280 upwardly along arrow "K" as the contact body 280 moves in the same direction. The weapon launcher 280 includes several openings 286 with slits 288 that are configured to receive projectiles 290 in proper alignment.

The contact body 380 includes a pair of extensions or projections 382 and 384 located at opposite ends thereof. As the contact body 380 moves along the direction of arrow "K," the extensions 382 and 384 move in the same direction. Cover portions 146 and 148 have extensions or abutments 156 and 158, respectively, that extend from the cover portions 146 and 148. The abutments 156 and 158 are engaged by the extensions 384 and 382 as the extensions 384 and 382 are moved upwardly. As a result, cover portions 146 and 148 pivot outwardly along the directions of arrows "L" and "M," respectively.

Each of the cover portions 146 and 148 is biased toward its closed position by a biasing member, such as a spring. When the actuator 300 moves from position 316 to position 314, the contact body 380 and extensions move downwardly in the direction opposite to arrow "K," thereby allowing the biasing members to bias the cover portions 146 and 148 to their closed positions, thereby reconfiguring or repositioning the cargo bay 140.

Figure 14:
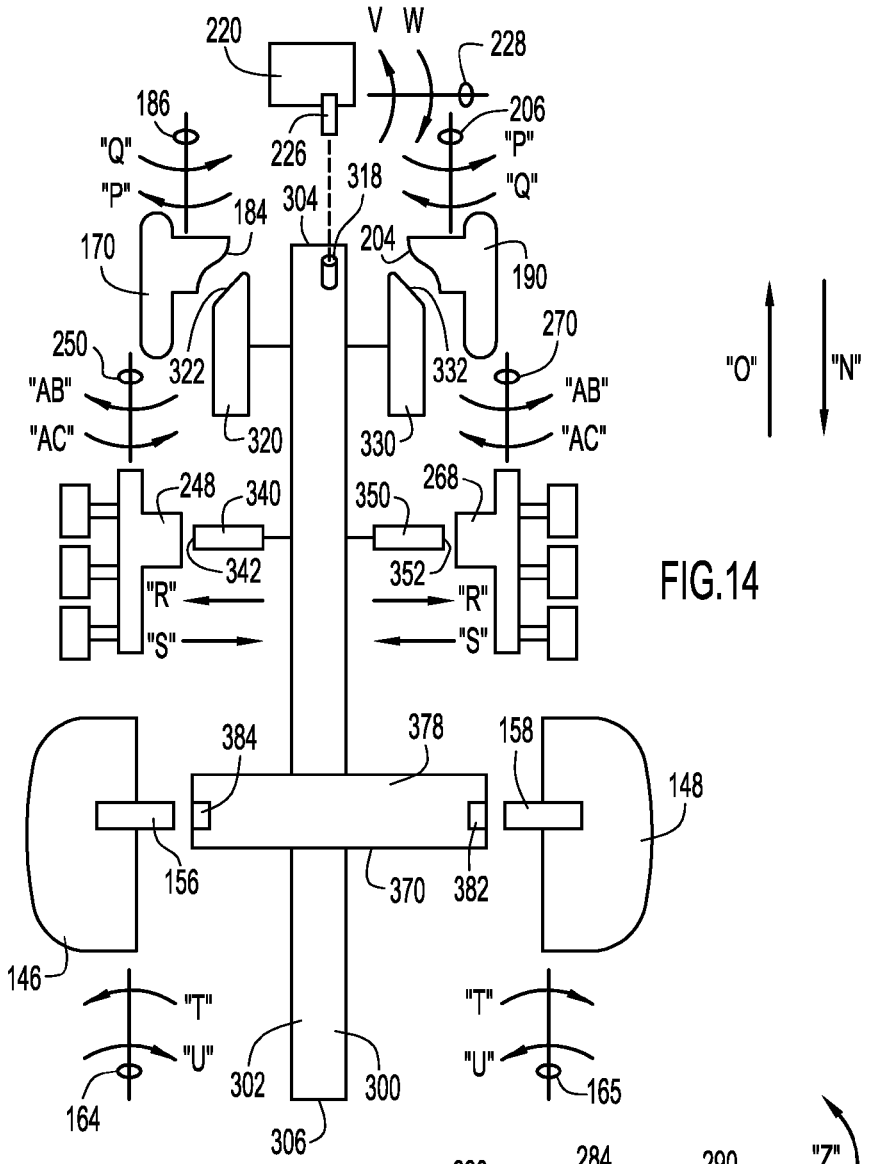
FIG. 14 illustrates a top schematic view of various components of the toy vehicle illustrated in FIG. 2.
Figure 15:
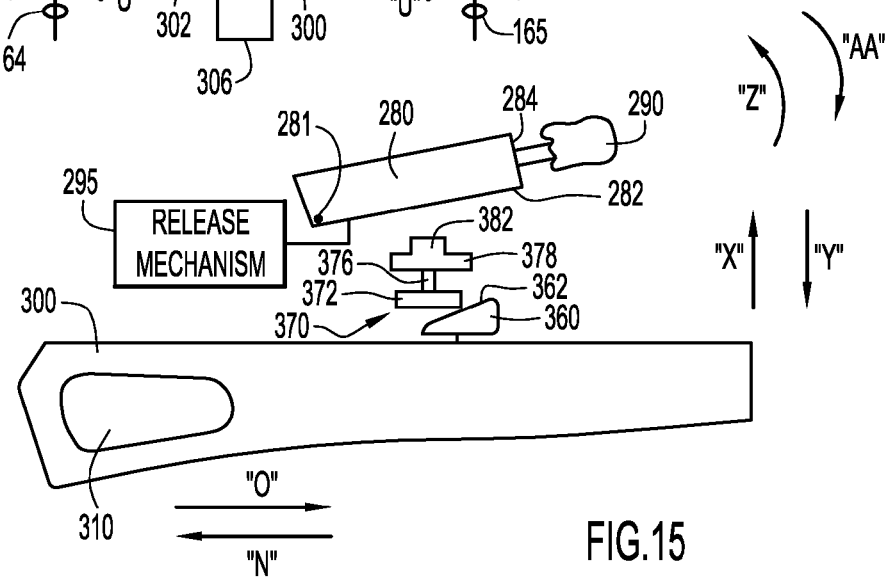
FIG. 15 illustrates a side schematic view of various components of the toy vehicle illustrated in FIG. 2.

Referring to FIGS. 14 and 15, schematic diagrams illustrating the relative movements of the components of the toy vehicle 100 are illustrated. As shown, the actuator 300 has a body 302 with opposite ends 304 and 306 and opening 310. The actuator 300 is movable along the directions of arrows "N" and "O" to its different positions.

Movement of the actuator 300 from its first position 312 to its second position 314 along arrow "N" causes cams 320 and 330 with cam surfaces 322 and 332 to disengage from cam surfaces 184 and 204 of weapons 170 and 190. This disengagement allows biasing members to move the weapons 170 and 190 about axes 186 and 206 along the directions of arrows "P" to their deployed or extended positions. At the same time, cams 340 and 350 with cam surfaces 342 and 352 move along the directions of arrows "R" into engagement with tabs 248 and 268, thereby pivoting landing gear portions 240 and 260 along arrows "AC" about axes 250 and 270 to their retracted positions. In addition, landing gear 220 has an extension 226 connected to coupler 318 so that this movement of actuator 300 causes landing gear 220 to pivot along the direction of arrow "W" about axis 228 to its retracted position.

Movement of the actuator 300 from its second position 314 to its third position 316 along arrow "N" causes cam 360 (see FIG. 15) with cam surface 362 to engage component 370. This engagement of component 370 causes the component 370, along with post 376 and upper portion 378 defining contact body 380 with projections 382 and 384, to move along the direction of arrow "X." The contact body 380 engages the lower surface 282 of weapon launcher 380, thereby pivoting launcher 280 along the direction of arrow "Z" about pivot point or axis 281. The launcher 280 is illustrated with projectiles 290 extending from end 284. In one embodiment, the weapon launcher 280 includes a release mechanism 295 that is activated by the pivoting of launcher 280 about point 281. Activation of the release mechanism 295 results in the launching of a projectile 290 from the launcher 280. In another embodiment, the release mechanism 295 of the weapon launcher 280 may be activated by moving the actuator 300 to the first, second or third position.

In addition, movement of the projections 382 and 384 into engagement with abutments 158 and 156, respectively, causes the cover portions 148 and 146 to pivot along the directions of arrows "T" about axes 165 and 164 from their closed positions to their opened positions.

When the actuator is moved from its third position 316 back its second position 314 along arrow "O," the component 370 moves along arrow "Y" and launcher 280 moves along arrow "AA" (see FIG. 15) and cover portions 146 and 148 pivot along arrows "U" (see FIG. 14) from their opened positions to their closed positions due to the biasing forces of biasing members.

When the actuator is moved from its second position 314 to its first position 312 along arrow "O," cam members 340 and 350 move along arrows "S" and landing gear portions 240 and 260 are biased along arrows "AB" from their retracted positions to their extended positions by biasing members. In addition, landing gear portion 220 is biased along arrow V" to its extended position by a biasing member. Also, cam members 320 and 330 move along the direction of arrow "O" and weapons 170 and 190 are pivoted to their retracted positions along the direction of arrows "Q."

Figure 16:
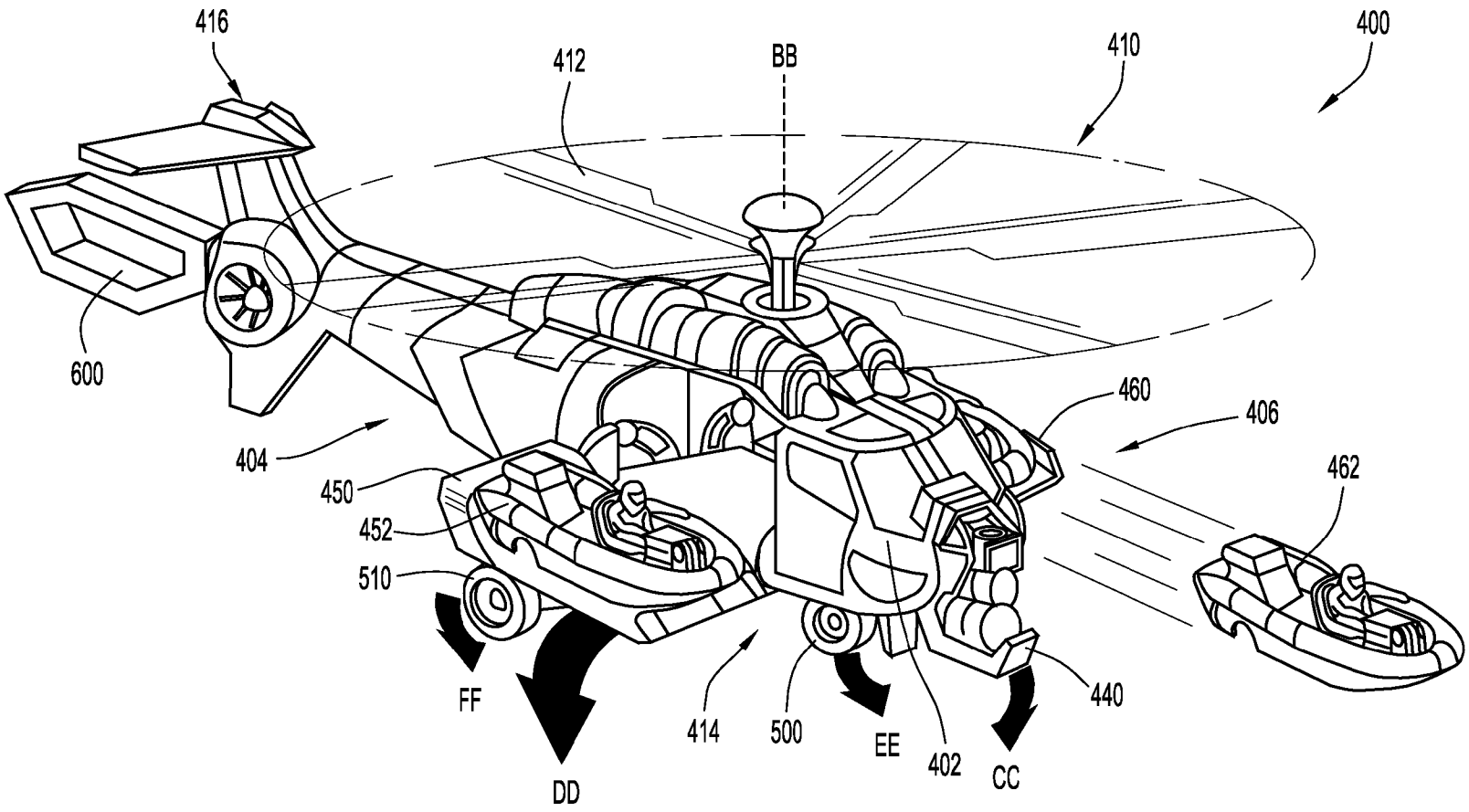
FIG. 16 illustrates a perspective front view of a second embodiment of a toy vehicle according to the present invention.
Figure 17:
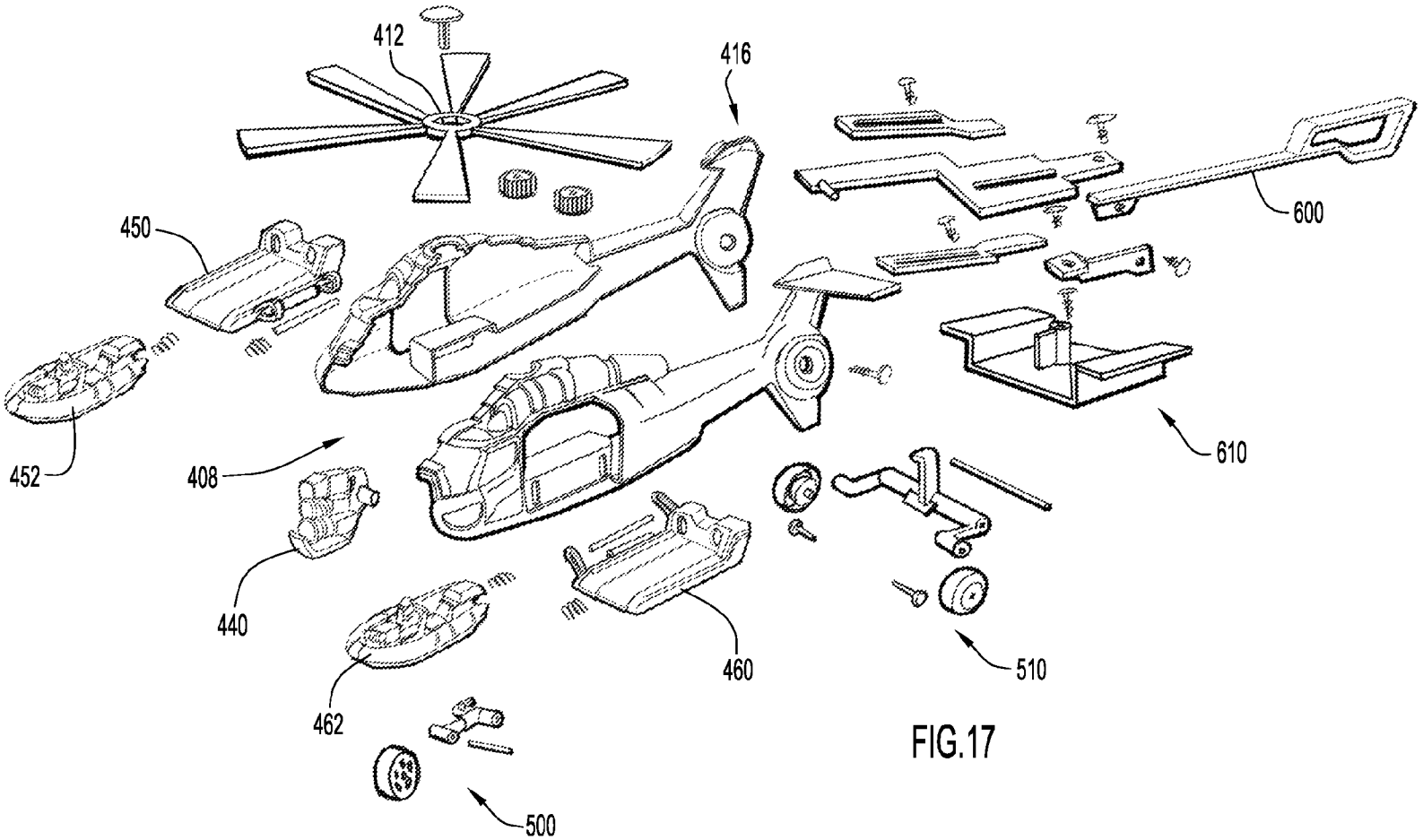
FIG. 17 illustrates an exploded view of the toy vehicle illustrated in FIG. 16.

FIGS. 16 and 17 illustrate a second embodiment of a toy vehicle according to the present invention. The toy vehicle 400 is configured to resemble a helicopter. In this embodiment, the toy vehicle 400 includes a body 402 with a first side 404, a second side 406, a front portion 408, and a tail portion 416. Furthermore, the body 402 has an upper surface 410 and a lower surface 414.

The toy vehicle 400 includes several mechanisms or repositionable portions that are movable relative to the body 402 of the toy vehicle 400. One repositionable mechanism is a propeller 412 that is rotatably coupled to the top surface 410 of the body 402 of the toy vehicle 400. Another repositionable mechanism is the front lights 440 that are pivotably coupled to the front portion 408 of the body 402 of the toy vehicle 400. Two additional repositionable mechanisms are the bay doors 450 and 460. The first bay door 450 is pivotably coupled to the first side 404 of the body 402 of the toy vehicle 400. The second bay door 460 is pivotably coupled to the second side 406 of the body 402 of the toy vehicle 400. Another repositionable mechanism is the landing gear 500 and 510 that is pivotably coupled to the lower surface 414 of the body 402 of the toy vehicle 400. The landing gear 500 and 510 consists of front landing gear 500 and rear landing gear 510.

Referring to FIG. 16, the toy vehicle 400 is illustrated with the bay doors 450, 460 pivoted to their open positions. As illustrated, the first bay door 450 pivots to the open position along path "DD". The second bay door 460 pivots open in a similar manner. Furthermore, in this embodiment, each of the bay doors 450, 460 houses or supports a boat 452, 462, respectively. First boat 452 is releasably attached to first bay door 450, and second boat 462 is releasably attached to second bay door 460. When the bay doors 450, 460 are in the closed position, the boats 452, 462 are housed within the body 402 of the toy vehicle 400.

FIG. 16 further illustrates the front lights 440 pivoted to a deployed position. The front lights 440 pivot out of the front portion 408 of the body 402 of the toy vehicle 400 along path "CC." Furthermore, the propeller 412 is rotatably coupled to the top surface 410 of the body 402 of the toy vehicle 400, and configured to rotate about axis "BB." Moreover, FIG. 16 illustrates the rear landing gear 510 in the deployed position. The rear landing gear 510 pivots away from the lower surface 414 of the body 402 of the toy vehicle 400 along path "FF." Similarly, front landing gear 500 is illustrated in its deployed position, with the front landing gear 500 being pivotable away from the lower surface 414 of the body 402 of the toy vehicle 400 along path "EE." Finally, FIG. 16 illustrates an actuator 600 extending from the tail portion 416 of the body 402 of the toy vehicle 400.

As illustrated in FIG. 17, which shows an exploded view of the toy vehicle 400, the actuator 600 contains various pieces that construct or form the internal actuation mechanism 610 that facilitates movement of the actuator to result in various outputs, as described below. The actuator 600 contains three positions, similar to that of the first embodiment described previously. When the actuator 600 is in its first position, the landing gear 500, 510 is in their deployed position. As the actuator 600 is pulled out of the tail portion 416 of the toy vehicle 400, to its second position, the internal actuation mechanism 610 is partially engaged with the landing gear 500, 510, the front lights 440, and the propeller 412. When the actuator 600 is in or moves to the second position, the front lights 440 rotate to the deployed position out of the front portion 408 of the toy vehicle 400. Furthermore, the propeller 412 begins to rotate about axis "BB" and the landing gear 500, 510 is retracted to be adjacent to the lower surface 414 of the body 402 of the toy vehicle 400.

In addition, the actuator 600 can be pulled farther out from the tail portion 416 of the toy vehicle 400 to a third position, causing the internal actuation mechanism 610 to engage the bay doors 450, 460. When the actuator 600 is pulled into the third position, the bay doors 450, 460 open up on the sides 404, 406 of the body 402 of the toy vehicle 400. Once the bay doors 450, 460 open, the boats 452, 462 are launched from the bay doors 450, 460.

The actuator 600 can then be repositioned to the second position and to the first position by pushing the actuator 600 into the tail portion 416 of the toy vehicle 400. When the actuator 600 is returned to the first position, the bay doors 450, 460 close, the front lights 440 pivot within the front portion 408 of the body 402 of the toy vehicle, and the landing gear 500, 510 pivots away from the lower surface 414 to their deployed position.

It is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

What is claimed is:

1. A toy vehicle, comprising:

a body including at least one detent;

a first mechanism coupled to the body and reconfigurable between at least a first position relative to the body and a second position relative to the body;

a second mechanism coupled to the body and reconfigurable between at least a first position relative to the body and a second position relative to the body; and an actuator coupled to the first mechanism and the second mechanism, the actuator being movable relative to the body from a first position to a second position and to a third position where the at least one detent secures the actuator in at least the second position, the movement of the actuator from the first position to the second position causing the first mechanism to move from its first position to its second position relative to the body, and the movement of the actuator from its second position to its third position causes the second mechanism to move from its first position to its second position relative to the body, wherein the actuator extends from the body a first distance in its first position and a second distance in its second position, and the second distance is greater than the first distance.

2. The toy vehicle of claim 1, wherein the actuator extends from the body a third distance in its third position, and the third distance is greater than the second distance and the first distance.

3. The toy vehicle of claim 1, wherein a third mechanism is coupled to the body, the third mechanism is reconfigurable between at least a first position relative to the body and a second position relative to the body, and the third mechanism moves from its first position to its second position as the actuator moves from its first position to its second position.

4. The toy vehicle of claim 1, wherein the toy vehicle is a toy plane, the first mechanism is a landing gear portion, the first position of the landing gear portion is an extended position and the second position of the landing gear portion is a retracted position.

5. The toy vehicle of claim 1, wherein the second mechanism is a cargo bay with cover portions, the first position of the cargo bay includes the cover portions being closed, and the second position of the cargo bay includes the cover portions being opened.

6. The toy vehicle of claim 3, wherein the third mechanism is a toy weapon, the first position of the toy weapon is a retracted position, and the second position of the toy weapon is an extended position.

7. The toy vehicle of claim 3, wherein at least one of the first mechanism and third mechanism moves from its second position to its first position when the actuator reaches its third position.

8. The toy vehicle of claim 3, wherein the third mechanism deploys at least one projectile when the actuator reaches its third position.

9. The toy vehicle of claim 1, wherein the actuator is slidably mounted to the body, and the actuator is moved in a linear direction from its first position to its second position and to its third position.

10. A toy vehicle, comprising:

a body having at least one positioning mechanism, a first mechanism coupled to the body at a first location, and a second mechanism coupled to the body at a second location, the second mechanism being different than the first mechanism, each of the first mechanism and the second mechanism reconfigurable between at least a first position relative to the body and in a second position relative to the body; and an actuator engageable with the first mechanism and the second mechanism, the actuator being movable relative to the body from a first position to a second position and to a third position where the at least one positioning mechanism secures the actuator in each of the first position, the second position, and the third position, the actuator engaging the first mechanism when the actuator reaches its second position causing the first mechanism to move from its first position to its second position relative to the body, and the actuator engaging the second mechanism when the actuator reaches its third position causing the second mechanism to move from its first position to its second position relative to the body, wherein the actuator extends from the body a first distance in its first position, a second distance in its second position, and a third distance in its third position, and the second distance is greater than the first distance and the third distance is greater than the second distance and the first distance.

11. The toy vehicle of claim 10, wherein the actuator is slidably mounted to the body, and the actuator is moved in a linear direction from its first position to its second position and to its third position.

12. The toy vehicle of claim 10, wherein the toy vehicle is a toy helicopter, the first mechanism is a propeller portion, the first position of the propeller portion is a stationary position and the second position of the propeller portion is a spinning position.

13. The toy vehicle of claim 10, wherein the second mechanism is a plurality of cargo bay doors with a plurality of launchable boats, the first position of the plurality of cargo bay doors is a closed position with the plurality of launchable boats located within the body of the toy vehicle, and the second position of the plurality of cargo bay doors is an open position with the plurality of launchable boats ejected from the cargo bay doors.

14. The toy vehicle of claim 10, wherein the body has a third mechanism coupled to the body, the third mechanism is placeable in a first position relative to the body and in a second position relative to the body, and the actuator engaging the third mechanism when the actuator reaches its third position causing the third mechanism to move from its first position to its second position.

15. A toy vehicle, comprising:

a body having at least one detent, a first repositionable portion, and a second repositionable portion; and an actuator movably coupled to the body, the actuator being disposable in a first actuating position and in a second actuating position relative to the body, where the at least one detent secures the actuator in the first actuating position and the second actuating position, the movement of the actuator from an initial position to the first actuating position causes the first repositionable portion to change its position relative to the body when the actuator reaches the first actuating position, and the movement of the actuator from the first actuating position to the second actuating position causes the second repositionable portion to change its position relative to the body when the actuator reaches the second actuating position, wherein the actuator extends from the body a first distance in its initial position, a second distance in its first actuating position, and a third distance in its second actuating position, and the second distance is greater than the first distance and the third distance is greater than the second distance and the first distance.

16. The toy vehicle of claim 15, wherein the actuator is slidably mounted to the body, and the actuator is moved in a linear direction from its initial position to its first actuating position and to its second actuating position.

17. The toy vehicle of claim 15, wherein the body has a third repositionable portion, the third repositionable portion changes its position relative to the body of the toy vehicle when the actuator reaches its second actuating position.

* * * * *

UNITED STATES PATENT AND TRADEMARK OFFICE

CERTIFICATE OF CORRECTION

PATENT NO. : 9,101,849 B2
APPLICATION NO. : 13/592968
DATED : August 11, 2015
INVENTOR(S) : Mauricio Bedolla et al.

It is certified that error appears in the above-identified patent and that said Letters Patent is hereby corrected as shown below:

In The Specification

Column 6, line 42, change “minor” to --mirror--; and

Column 7, line 42, change “minor” to --mirror--.

Signed and Sealed this
Fifth Day of January, 2016

Michelle K. Lee

Michelle K. Lee
*Director of the United States Patent and Trademark Office*